US005156402A

United States Patent [19]

Hart

[11] Patent Number: 5,156,402

[45] Date of Patent: Oct. 20, 1992

[54] SWING TRAINING MACHINE

[76] Inventor: James E. Hart, 163 Autumn Dr., Trafford, Pa. 15085

[21] Appl. No.: 699,328

[22] Filed: May 13, 1991

[51] Int. Cl.[5] ..... A63B 69/36; A63B 15/00; A63B 21/02

[52] U.S. Cl. ..... 273/191 R; 273/191 B; 273/26 R; 273/29 A; 482/109; 482/122

[58] Field of Search ..... 273/191 R, 191 A, 191 B, 273/186 R, 183 B, 193 R, 193 A, 26 R, 26 B, 29 A; 272/116, 134, 135; 482/92, 109, 112, 121-123, 128, 129, 133

[56] References Cited

U.S. PATENT DOCUMENTS

| | | | |
|---|---|---|---|
| 2,472,065 | 6/1949 | Cottingham | 273/35 |
| 3,415,523 | 12/1968 | Boldt | 273/186 |
| 3,429,571 | 2/1969 | Abel | 273/26 |
| 3,604,712 | 9/1971 | Prior | 273/35 X |
| 3,614,108 | 10/1971 | Garten | 273/190 R |
| 3,738,661 | 6/1973 | Moller | 273/191 R |
| 3,876,212 | 4/1975 | Oppenheimer | 273/186 R |
| 3,966,203 | 6/1976 | Bickford | 273/191 B |
| 4,135,714 | 1/1979 | Hughes | 273/191 B |
| 4,243,219 | 1/1981 | Price | 273/26 B |
| 4,268,035 | 5/1981 | Oppenheimer | 273/186 A |
| 4,326,718 | 4/1982 | Kiehl | 273/183 B |
| 4,448,412 | 5/1984 | Brentham | 272/134 |
| 4,653,757 | 3/1987 | Wilkinson | 273/191 R |
| 4,758,000 | 7/1988 | Cox | 273/190 R |
| 5,050,874 | 9/1991 | Fitch | 273/191 R |

*Primary Examiner*—V. Millin
*Assistant Examiner*—Steven B. Wong

[57] ABSTRACT

A versatile swing training machine for developing muscular strength and coordination to perform athletic swings typical of baseball, golf, hockey, or tennis. A drive arm pivotably carried on a frame is engaged and forcibly driven in rotation by a partially guided hand-held swing implement, against a variable resistance developed by a resistance element and imparted through a linkage mechanism. The resistance element may include a fluid damping device and a mechanical spring, which also assists the return swing of the drive arm. The linkage mechanism transmits linearly developed resistance and translates it to torsional resistance on the drive arm, equally for right and left-handed swings. Optimum training resistance is gradually maximized through the acceleration zone of the swing and tapers off during the followthrough, being effective for the full forward swing. The backswing is relatively unresisted. Adjustments accommodate various swing positions as well as individual differences in height and reach.

26 Claims, 7 Drawing Sheets

POS. 1

POS. 2

POS. 3

POS. 4

POS. 5

POS. 6

SWING TRAINING MACHINE

FIELD OF THE INVENTION

This invention relates to sports training equipment and in particular to a machine used to improve a person's ability to perform the swing motions required in any one of a number of athletic games or sports.

BACKGROUND OF THE INVENTION

In athletic sports such as baseball, softball, golf, tennis, hockey, and the like, implements such as bats, clubs, rackets or sticks are swung to strike and propel a ball or puck. In each of these sports particular body positions, or stances, and particular swinging motions are used to achieve this. While there are certain differences between the stances, swing planes, and swing motions for baseball, golf, hockey, and tennis, there are also important similarities.

In most such swinging motions, the implement that is swung moves in a path that is generally a planar arc about a pivot point or axis. This path may not always be a perfect circular arc about a fixed pivot point in one plane, but the striking portion of the bat, club, stick, or racket moves in a path that generally approximates such a centrifugal arc. The central pivot point or axis of rotation for these athletic swinging motions lies in the vicinity of the inner side of the upper spinal column between the shoulders of the person performing the swing, more or less central to the upper torso and neck.

In each athletic swing, precise positional control of the swing path, through the striking point, is very important. Also, mechanical efficiency of the entire swing motion, acceleration and power all contribute to the effectiveness of hitting in these sports. Specific muscle coordination and strength are required of all of the muscles which come into play, and in some cases muscular endurance is also needed. Particular muscles in the legs, torso, shoulders, arms, forearms, wrists and hands all contribute to such swinging actions.

The present invention utilizes two well known and widely accepted training concepts to develop proficiency in particular athletic skills. The first is that muscle strength and endurance are developed by repeatedly contracting the muscles against resistance, through a particular range of motion; and the second is that training is specific. This means that training of a coordinated group of muscles used to perform a specific action can effectively be achieved by repeatedly performing the actual, specific event. Athletic maneuvers, such as proficiently swinging a bat, club or racket, require learning and repetitive training to improve muscular coordination, power and control.

In most sports requiring a ball to be struck and propelled by a swung implement, one of the primary objectives is to strike the ball with as much force as possible. In baseball, softball and golf, for example, it is often desirable to hit the ball as far as possible, and in tennis it is helpful to hit with control and velocity. This requires a high degree of muscular power along with good control of the swing path. The baseball swing seemingly requires the most muscle power because of the weight of the typical bat and the rapid acceleration that is required due to the very brief response time allowed by a fast pitch. This muscle strength can be developed most effectively by working all of the coordinated muscles involved, against resistance, through a critical range of motion. The most critical range of the swing motion, where the most strength is required, is from the starting position of the swing up to the point of contact with the ball. It is through this zone that the bat or club must be rapidly accelerated and driven, to maximize the force and momentum at the impact point. This momentum is the product of the fixed mass and impact velocity of the bat or club head. A continued driving force through impact also helps to overcome the opposite momentum of a baseball or resting inertia of a golf ball or the like. The followthrough or completion of the swing after contact with the ball is important for assuring a proper and repeatable swing form, but not as important in terms of muscle strength.

The present invention provides a training device which accommodates a variety of particular swinging motions that apply to different athletic sports, while providing a variable resistance to such swings in the most appropriate realm of the swing path. By repeatedly using this device, the training effect can be achieved to improve the proficiency of a trainee's ability to perform such swings in the actual events.

It is also desirable to be able to develop efficient, powerful swing motions in either a clockwise or counter clockwise direction. There are, in all sports, both right-handed and left- handed swingers. In tennis, moreover, the ball may be struck with a forward swing that can be either a forehand or backhand stroke, and in baseball it is beneficial to be able to swing equally well from either side of the plate to compensate for right or left-handed pitchers. The present invention accommodates both forward swing directions and is particularly well suited for developing this switch hitting capability. In these cases involving swinging a bat, golf club or racket, such actual implements may be accommodated in using the training machine, but most often a special swing implement having a handle which replicates that of the appropriate implement and a relatively small diameter shaft extending from the handle will be used.

DESCRIPTION OF THE RELATED ART

In the art there are a multitude of swing training devices which are specifically aimed at precise guiding of the swing path of a golf club, to teach the feel of the proper swing through repetitive training and the associated muscle memory obtained from such training. Examples of such devices are covered by Cottingham's U.S. Pat. No. 2,472,065, Boldt's U.S. Pat. No. 3,415,523, Prior's U.S. Pat. No. 3,604,712, Oppenheimer's U.S. Pat. No. 3,876,212, and Cox's U.S. Pat. No. 4,758,000.

In each of these references, the inventions deal specially and only with the golf swing, having no application or anticipation of any application to baseball or softball, hockey, or tennis swings. In each of these other sports, the swing motions tend to vary more from a flat swing plane, from start to finish, and have more of a sweeping planar swing path than the golf swing.

Of the above mentioned references, only the invention of Cottingham provides resistance to the golf club during the swing for the stated purpose of building muscle power. In the invention of Cottingham, however, the resistance element consists of an adjustable rotary friction brake which has several serious limitations. As disclosed, having a set screw adjustment which acts only in one direction, the brake can only be effective for a maximum of about 90 degrees of rotation through the swing path, which is also the approximate length of the pivotable arcuate friction member shown in the drawings. Also in this case, while provision is made for the brake to have a jamming action to provide frictional resistance in the downswing direction, and to collapse on the return backswing to eliminate this resistance, it clearly cannot be adapted to serve both right-handed and left-handed golfers. It also appears that the resistance, once set, will be essentially constant through that short zone of the swing path where it is in effect. There is no provision for a gradual buildup of resistance at the start to allow the user to start smoothly into the swing and build some momentum prior to encountering full resistance.

In another golf training device as covered by Garten in U.S. Pat. No. 3,614,108, rotational resistance is provided, again for the purpose of developing muscle strength, by a set of friction discs clamped together face to face by a clamping screw and nut. Here again, once the pressure is set on the friction plates, the torsional swing resistance will be constant. Furthermore, there is no provision to reduce the frictional drag on the backswing which would make this device quite difficult to use. A great amount of wasted muscular force and energy would be required to perform the backswing each time a forward swing is made.

SUMMARY

As will become apparent in the course of the following description, the machine of my present invention overcomes each of these drawbacks of the prior art. By utilizing a linearly extendable resistance element combined with a flexible tension member and a special linkage to impart rotational resistance during a forward swing, these limitations implicit in the prior art are overcome. The present invention provides a controllable and adjustable resistance through a major effective zone of the forward swing path, while also providing an essentially resistance free or spring assisted return swing. It also intrinsically provides both of these features for both right-handed and left-handed swing directions.

Additionally, the present invention accommodates not only the typical golf swing position and swing path, but also readily accommodates the swing positions and swing paths typically used in baseball or softball, hockey, and various types of tennis strokes, including serving strokes as well as forehand and backhand ground strokes.

It is an object of my invention to provide a training device for improving an individual's muscular strength and ability to effectively perform the powerful swings required in any of a number of different athletic events such as baseball, softball, golf, hockey, tennis or the like. It is a related object to accommodate, through simple setup adjustments, the different swing positions and planar swing paths of the swing implements used in different sports, such implements having a handle and an actual or simulated shaft of a ball bat, golf club, tennis racket, hockey stick, or the like, and to provide a resistance acting essentially perpendicular to such a shaft, against the direction of movement, as it moves through such swing paths. It is a further object of my invention to provide the highest resistance through the acceleration zone of the swing path for efficiently developing maximum hitting power, and to provide for an unresisted or spring assisted return or backswing to the swing starting position.

It is also an object of the invention to provide adjustment means for varying the amount of resistance that is applied against a swing.

It is yet another object of my invention to be able to guide the shaft of the implement swung through a proper swing path and restricted swing plane to help a trainee to learn the feel of a proper swing and proper swing motions.

A further key object of my invention is to achieve all of these stated objectives for both right-handed and left-handed forward swing directions and to allow easy changeover from one swing direction to the other while using the machine. I t i s another object to accommodate differences in the physical height and reach of individuals, by providing adjustment means to vary the pertinent dimensions of the swing training device. Other objects and advantages of the present invention will become apparent in the course of the structural and functional descriptions which follow.

DETAILED DESCRIPTION OF THE EMBODIMENTS

Figure 1:
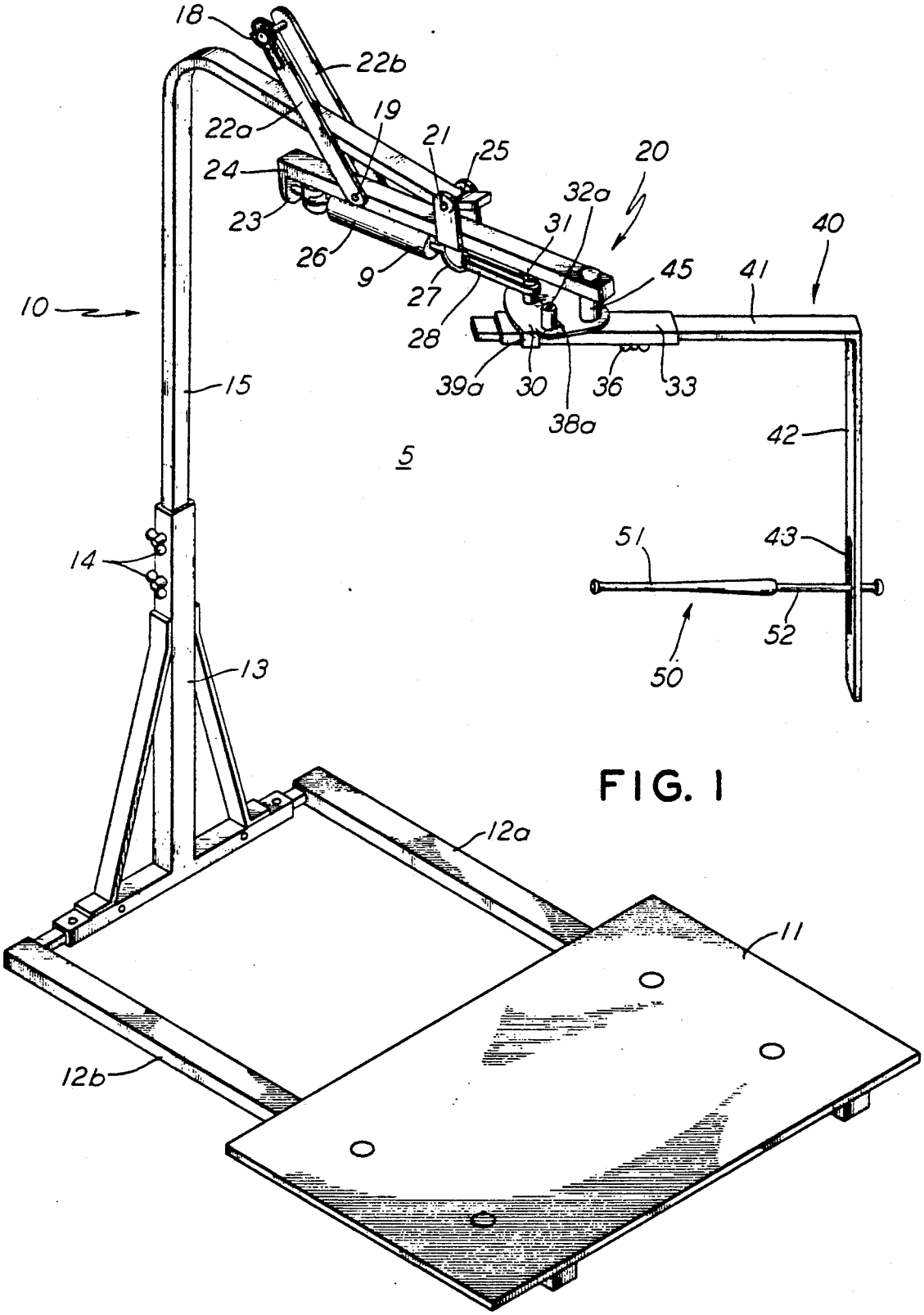
FIG. 1 of the drawings is an isometric view of a free standing embodiment of the swing machine.

Referring to FIG. 1 of the drawings, a principle embodiment of the swing training machine 5 includes an operating mechanism 20 carried by a frame 10. In this free standing embodiment the frame 10 includes a standing platform 11 attached to base frame members **12*a* and 12*b* which support an upright base post 13. An L-shaped cantilevered suspension bar 15 is slidably connected to and supported by the post 13, and a beam 24 is pivotably connected to the suspension bar 15 by a pin 21 carried in a clevis 25 and passing through suspension bar 15. The clevis 25 is rigidly carried on the beam 24. Two elongated locking bars 22*a* and 22*b* are, on one end, pivotably attached to the beam 24 by a pin 19** and can be clamped against the outside of the suspension bar 15. A cam operated clamp 18 is carried on the opposite ends of the locking bars.

The height of the suspension bar 15 and the operating mechanism 20 carried thereon is thereby adjustable and can be locked into the desired position by locking set screw 14; and the angular orientation of beam 24 and the operating mechanism 20 can be pivotably adjusted about the pin 21 and held in position by the locking bars 22*a* and 22*b* when clamped tightly about suspension bar 15.

The operating mechanism 20 includes a resistance device 26, a flexible tension strap or belt 28, a linkage plate 30, a drive arm carrier 33, and a swing drive arm 40. A swing implement 50 is to be held by the trainee and used to drive the drive arm in pivoted rotation. The components of the operating mechanism 20, excluding the swing implement 50, are carried directly or indirectly on the pivotable beam 24 of the frame 10.

Figure 8B:
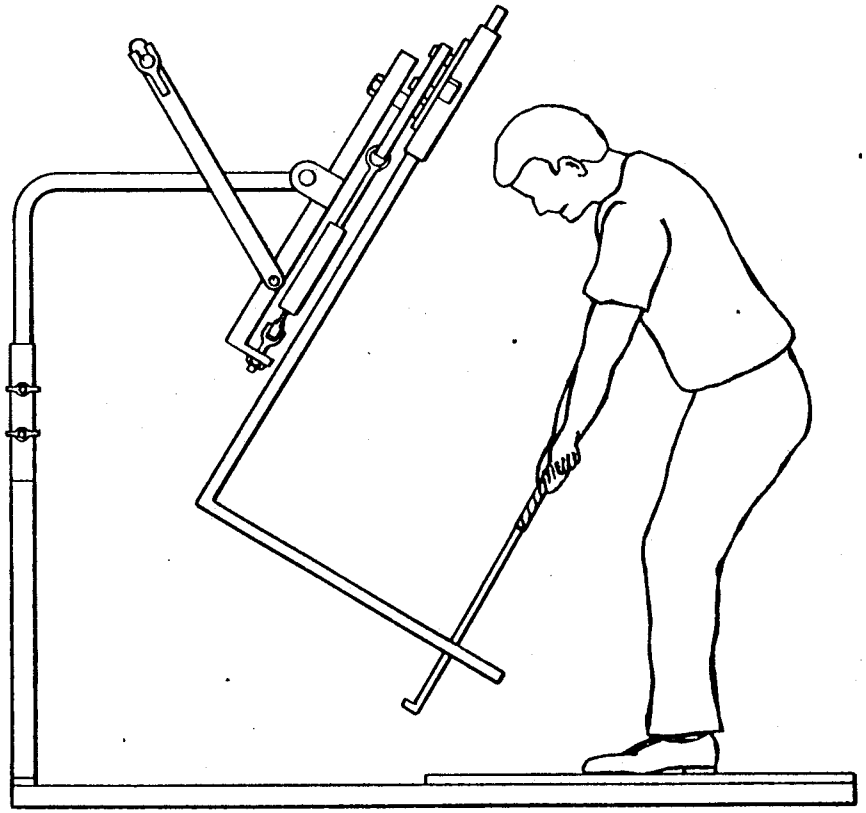
FIGS. 8A and 8B depict the overall general alignment of the swing training machine when set up for typical baseball and golf swings, respectively.
Figure 8A:
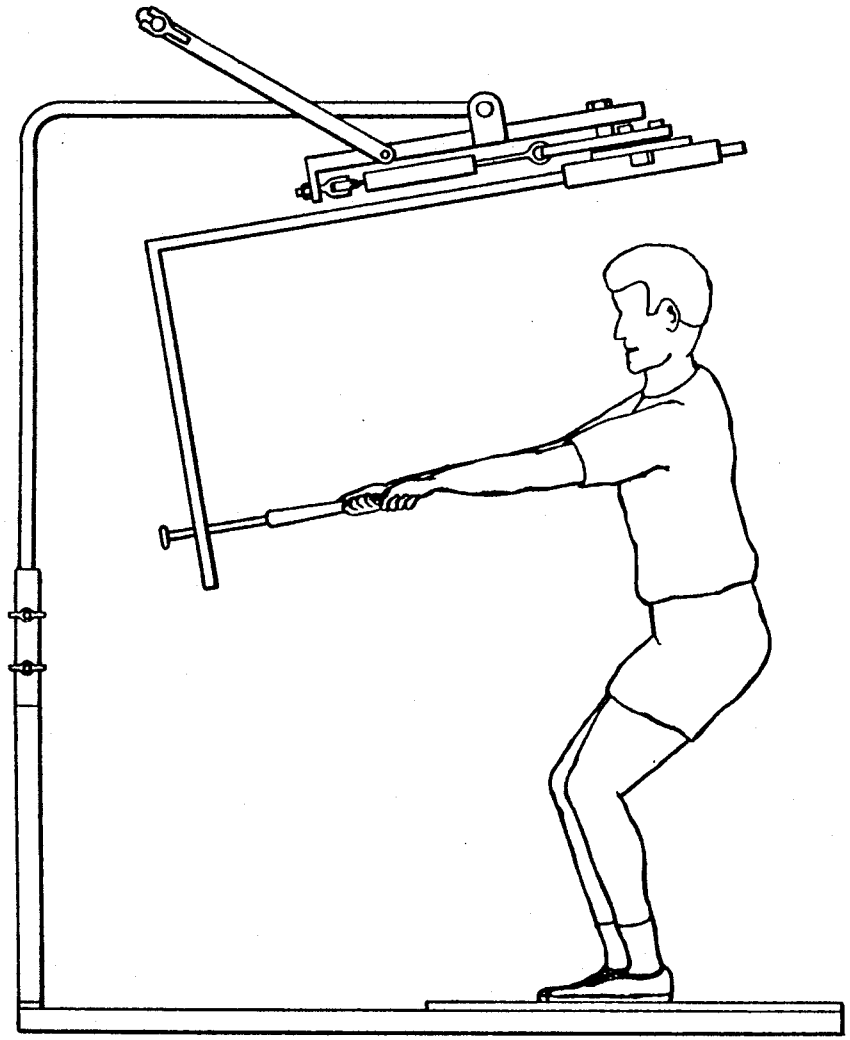

This permits the entire operating mechanism 20, along with the beam 24, to be pivoted about pin 21 from an essentially horizontal position, through at least 90 degrees to a generally vertical position, and to be locked into place at any desired angle between these extreme positions. It can be seen by referring to FIGS. 8A and 8B of the drawings that this achieves a corresponding adjustment and orientation of the swing plane of the swing implement, thus accommodating the more vertical planar swing paths used in golf, hockey, or certain overhead tennis serves and strokes, as well as the more horizontal swing paths and swing planes of baseball, softball, or lateral tennis strokes.

Referring once again to FIG. 1, pivotably connected to one end of the beam 24 is the drive arm carrier 33 and the L-shaped swing drive arm 40. Pivot pin 35 passes through a bearing carried on the beam 24 and connects rigidly to the top of drive arm carrier 33, setting the pivot axis of rotation for the drive arm assembly. The drive arm 40 is slidable within drive arm carrier 33 and locked into position by locking set screw 36. The effective radial length of the drive arm 40 can thereby be adjusted by slidably positioning it in drive arm carrier 33. Drive arm 40 has an elongated radial section 41 projecting generally perpendicular from the turning axis of pivot pin 35, and a second elongated section 42 which extends at an angle from the radial section 41 and is positioned generally parallel to this axis of rotation. While the embodiment shown illustrates the section 42 extending generally parallel to the pivot axis of drive arm 40, the disposition of these two sections of the swing drive arm may vary somewhat relative to the axis of rotation. The essence is that the first section 41 radiates outward to position the second section 42 beyond the body and arms of a person standing in a swinging position, while the section 42 extends downward at an angle of less than 90 degrees from the axis of rotation of the drive arm 40 to intersect the planar swing path and engage the hand held swing implement 50, as will be explained.

Figure 4:
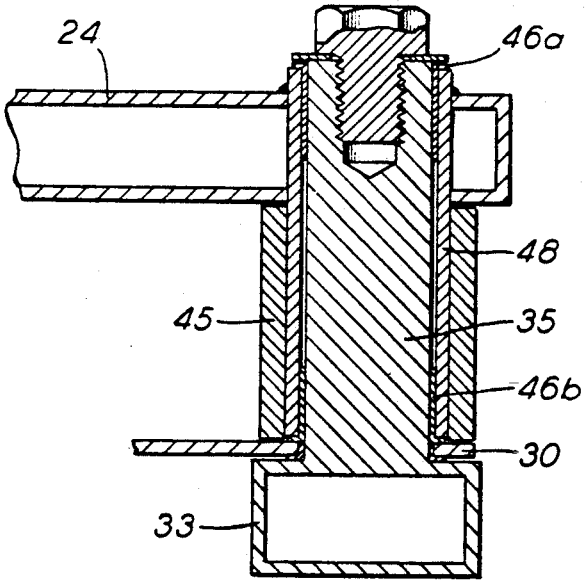
FIG. 4 is a section view of the pivot assembly of the drive arm mounting to the beam, including the bushing, bearings and pivot pin.

Referring to FIG. 4 of the drawings, illustrating a section view of the drive arm pivot assembly, it is shown that the pivot pin 35 rotates within a cylindrical bushing 48 and flanged bearings 46*a* and 46*b*. This bushing 48 is carried on the beam 24 of the frame 10 and projects beyond the lower surface of the beam, forming a cylindrical projection. A slip sleeve bearing 45 is carried circumferencially around this projection of bushing 48, and, as will be shown, this sleeve 45 provides a lateral bearing surface for the tension strap 28 during the latter a part of the swing.

Also illustrated by FIG. 4 is a partial section view of the linkage plate 30 showing that in this embodiment the plate 30 is mounted atop drive arm carrier 33 and pivots about drive arm pivot pin 35, thereby being supported by the bushing 48 of the beam 24, which is a part of the frame 10. In other embodiments not illustrated here, the plate 30 could pivot directly about the cylindrical projection of the bushing 48.

As shown on FIG. 1, the linkage plate 30 is pivotably connected to the beam 24 and slidably engages a top side of the drive arm carrier 33, with two projecting drive tabs 39*a* and 39*b* straddling the drive arm 40 and drive arm carrier 33 such that one of the two tabs 39*a* and 39*b* of the plate 30 forcibly abuts one side or the other (the leading side) of the drive arm carrier 33, depending on the direction of the forward swing. This linkage plate 30 is illustrated in a perspective view in FIG. 5 of the drawings, as assembled over the drive arm carrier 33 and pivot pin 35. In this preferred embodiment the linkage plate 30 has a first, generally flat surface facing away from the drive arm carrier 33 and an opposite second surface facing toward the drive arm carrier 33. Projecting from the first upper surface of the plate 30 are a connecting anchor pin 31 and tension strap pickup pins 32*a* and 32*b*, all of which are protrusions disposed generally perpendicular to the flat surfaces of the plate 30 and parallel to its pivot axis of rotation.

Referring again back to FIG. 1 an extendable tension resistance device 26 is anchored at one end to a projecting end plate 23 carried on beam 24, and is connected by way of the flexible tension strap 28 to the anchor pin 31 of the linkage plate 30. The resistance device 26 requires a force to linearly extend it. In the embodiment of FIG. 1 the resistance device 26 represents a cylindrical, piston operated fluid damper, which resists forcible longitudinal extension of a pull rod 27 by means of forcing fluid under pressure through restrictive orifices. The pull rod 27 constitutes an extendable member of the resistance device 26. Such devices offer the added advantage of allowing piston and rod retraction with little or no resistance, as the fluid is allowed to flow back through larger orifices. Such a fluid damper may also be accompanied by an internal or external mechanical spring to provide added resistance to extension of the pull rod and to provide a return force to assist retraction of the operating piston and rod back to a retracted starting position. During the backswing, therefore, when the resistance device 26 is retracting, with or without return spring assistance, the user or trainee needs to expend little or no effort to return to a forward swing starting position.

While the use of a fluid pressure damping cylinder as a linearly extendable resistance element is an integral part of certain embodiments of the present invention, such devices are well known, and the specific structure of applicable devices is not novel to this invention. Two types of fluid dampers are particularly well suited for use with the present invention, due to a relatively constant resistance output over a major portion of the piston stroke. In one such device a non-compressible hydraulic fluid is forced through a pre-adjustable orifice, and in the other, compressible fluid such as air is forced through one or a series of orifices which change the total flow capacity as the piston moves and the volumes change, to provide this relatively constant resistance output. The ability to externally adjust the orifice, to vary the resistance force, is a useful feature as used in the present invention to vary swing resistance.

Figure 6:
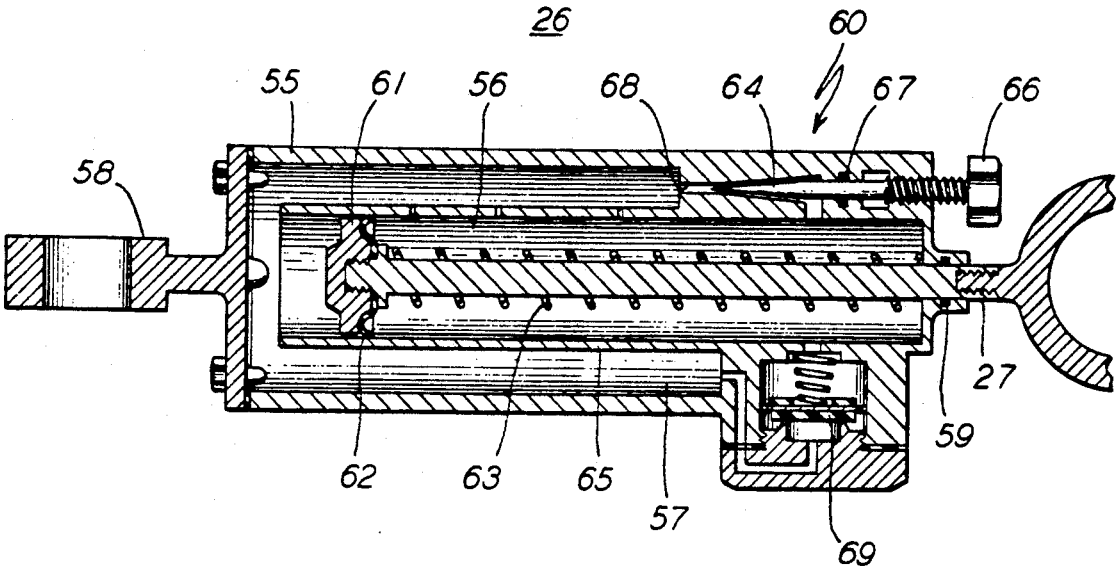
FIG. 6 is a longitudinal section view of a cylindrical fluid damping device for providing resistance.

A typical cylindrical fluid damper is illustrated in a longitudinal section view on FIG. 6 of the drawings. The extendable pull rod 27 is connected to a piston 61 having an elastomeric sliding seal 62 operable in the cylinder 65. The volume to the front of the piston, within the cylinder 65, makes up a first compression chamber 56. The pull rod 27 passes through a front rod seal 59, isolating the first compression chamber 56 from the outside of the cylinder. An second chamber 57, encased by the cylinder 55, surrounds the inner cylinder 65 and is open to the portion of this inner cylinder that is behind the sealed piston 61. A mechanical return spring 63 acts to force the piston 61 and pull rod 27 to a retracted position.

An adjustable needle valve 60 interrupts a flow passage 71 connecting first compression chamber 56 to the second outer chamber 57. A screw adjustor 66 operates a needle valve stem 64 which has a conical nose to mate with a conical valve seat 68. The stem is fitted with a stem seal 67. Adjusting the screw adjustor 66 inserts and withdraws the valve stem 64 to and from the seat 68 to control the size of the effective orifice available for fluid flow between the chambers 56 and 57, as fluid is forced to flow from chamber 56 to chamber 57 by forcible extension of the pull rod 27 and the sealed piston 61.

The flow restriction of the needle valve causes a buildup of pressure on the fluid within chamber 56, which resists the continued forward movement of the piston 61. A relatively unrestricted return of the piston 61 to a retracted position is achieved by allowing the fluid which has been forced into chamber 57 to flow back into chamber 56 through a high flow capacity one way check valve 69 as the piston 61 returns.

Figure 2:
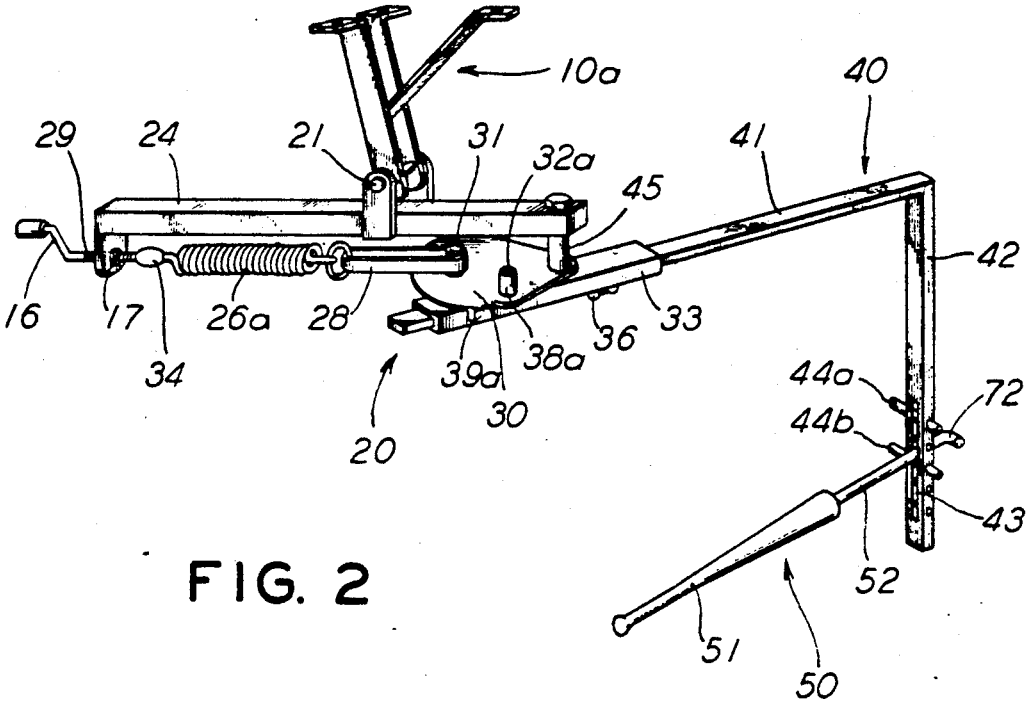
FIG. 2 is a similar view showing an overhead mounting arrangement and alternate embodiments for the resistance device and the swing drive arm engagement with a swing implement.

In another embodiment, as illustrated in FIG. 2, the resistance element consists of only a linearly acting tension spring 26*a*. An end of the spring 26*a* itself serves as an extendable member. The spring 26*a* is connected to the plate 23 by a swivel 34 and a longitudinal adjusting screw 29 operated by a crank 16 and locked by locking nut 17. The screw adjustor 29 serves to adjust the initial spring tension load applied to tension strap 28 and the linkage plate 30, by varying the position of the anchor point of the spring 26*a*.

The embodiment of the invention illustrated in FIG. 2 shows the spring 26*a* serving as the resistance device, as explained, and also shows the beam 24 and the operating mechanism 20 as suspended from an overhead mounting frame 10*a*, rather than carried on the free standing frame 10 as shown in FIG. 1. The use of the tension spring 26*a* and the overhead mounting are independent of one another.

Figure 3:
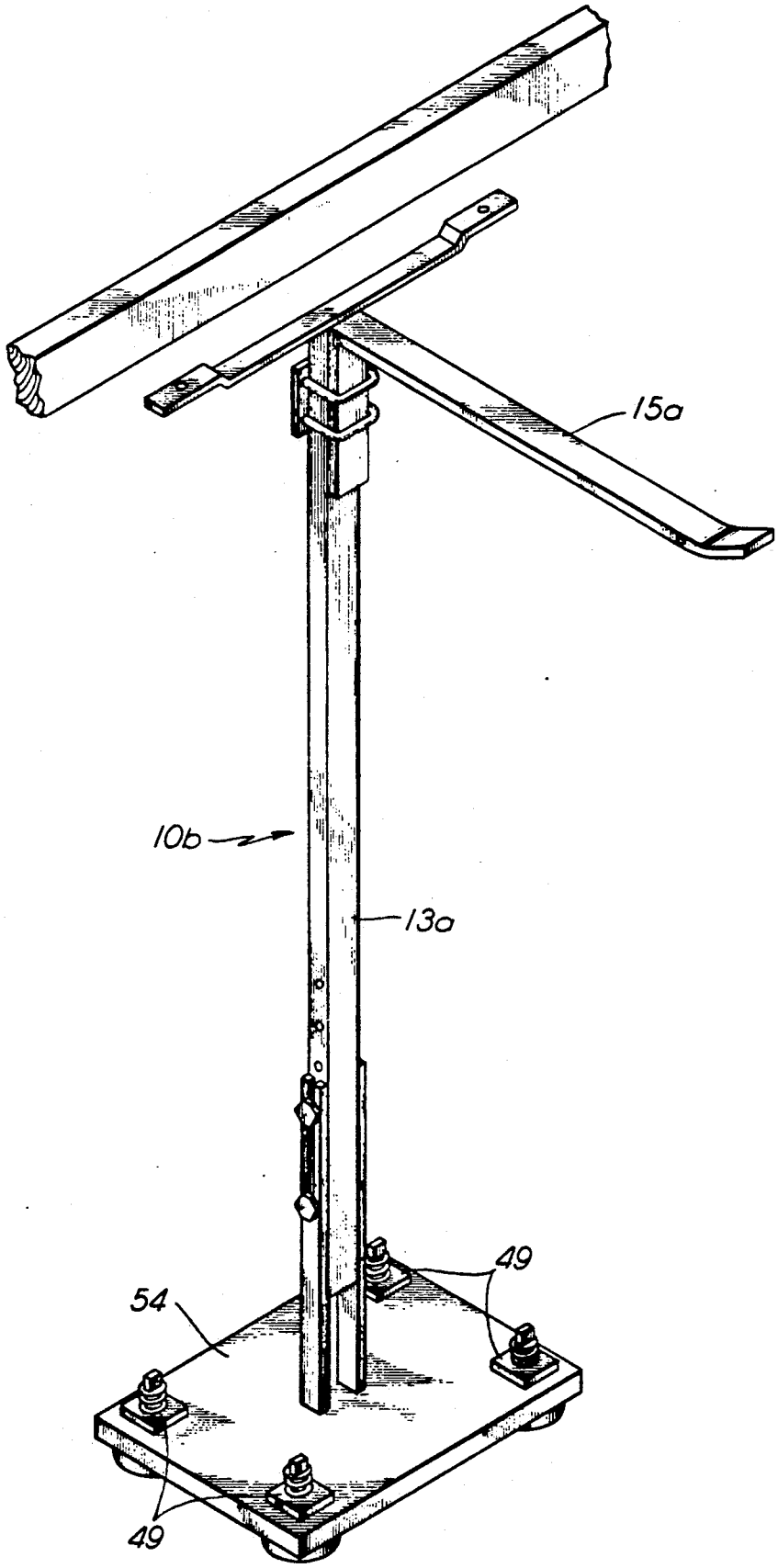
FIG. 3 illustrates a wedged upright post embodiment of the frame.

FIG. 3 of the drawings partially illustrates yet another embodiment of the invention wherein a frame 10*b* includes a base plate 54, holding an upright post 13*a*, and cantilevered suspension bar 15*a*, slidably and lockably carried on the post 13*a*. In this case the upright post 13*a* is wedged tightly between a floor and an overhead structure such as a ceiling joist for stability. This tight wedging is achieved by a plurality of screws adjustors 49 which mount to the base plate 54 and drive a plurality of feet 53.

It is important to note that the frame 10, or the frame 10*a* or 10*b*, must rigidly support the beam 24 and absorb the changing torsional loading of the beam 24 which occurs each time a training swing is forcibly made against the resistance provided by the resistance device 26 or 26*a*. In the case of frame 10*a* of FIG. 2 or frame 10*b* of FIG. 3, this load will be transmitted to a fixed structure by which the frame is supported. In the case of the free standing frame 10, as illustrated in FIG. 1, however, the weight of a trainee standing on the platform 11 serves to stabilize the frame. An important advantage of the free standing embodiment of the swing machine of FIG. 1 is that it is self-contained and can be moved from place to place.

Referring to FIG. 1, a swing implement 50, having a handle 51 and a shaft 52, slidably engages a slot 43 in the swing drive arm 40. The swing motion of a bat, club, or racket is accommodated as a trainee stands on the platform 11 facing the upright post 15 and grips and swings the swing implement 50. The swing path is guided by the engagement of the shaft 52 with the slot 43 of swing drive arm 40, as the drive arm is driven to rotate about pivot pin 35. Some limited vertical movement of the shaft 52 is accommodated by its sliding up and down within and along the slot 43, and some longitudinal movement of the shaft relative to the swing drive arm 40 is accommodated by the sliding of the shaft 52 in and out longitudinally, or radially, through the slot 43 as the complete swinq is performed. Also, as provided in this embodiment, it is important that this engagement of the shaft with the drive arm 40 allows the angular orientation of the shaft 52 with respect to the drive arm 40 to vary substantially as a full swing is made. The longitudinal alignment of the shaft 52 does not constantly aim directly at the axis of rotation of the drive arm due to the cocking and uncocking of the trainee's wrists during a swing. This relatively free angular movement is well accommodated by the abutting engagement of the sides of the shaft 52 of the swing implement 50 with the sides of the slot 43 of the drive arm 40.

As indicated by the drawings, the shaft 52 abuts one internal lateral side or the other of the slot 43 during a right or left-handed forward swing, and abuts the opposing side during the subsequent return swing.

As shown on FIG. 2, the end 72 of swing implement shaft 52 protrudes generally perpendicular to the longitudinal axis of the shaft, so that the shaft can be inserted through the slot 43 but, when turned 90 degrees, will be obstructed from retraction out of the slot.

The degree of vertical movement of the shaft 52 along the slot 43 which is accommodated during the swing establishes the limits of the planar range of the swing path, or the depth of the swing plane. In the embodiment shown on FIG. 2, one or two shaft containment pins 44*a* and 44*b* pass through any of a plurality of holes laterally through drive arm 40 and slot 43, to further restrict the freedom of movement of the shaft 52 upward and downward in the slot 43. This feature thereby selectively restricts the shaft 52 of swing implement 50 such that its swing path must stay within a fixed or restricted planar range throughout a full swing. This is particularly suitable in training to properly develop the golf swing, where a tightly controlled swing plane is desirable, but it is also applicable for other sports.

Since pins 44*a* and 44*b* project to the outside of swing drive arm 40, they similarly would serve to limit the sliding movement of an actual ball bat or tennis racket, for example, when abuttingly engaged with the outside surface of the drive arm 40, if such actual swing implements are used. This arrangement is most practical with those embodiments of the swing training machine having a spring assisted return of the drive arm.

Figure 9:
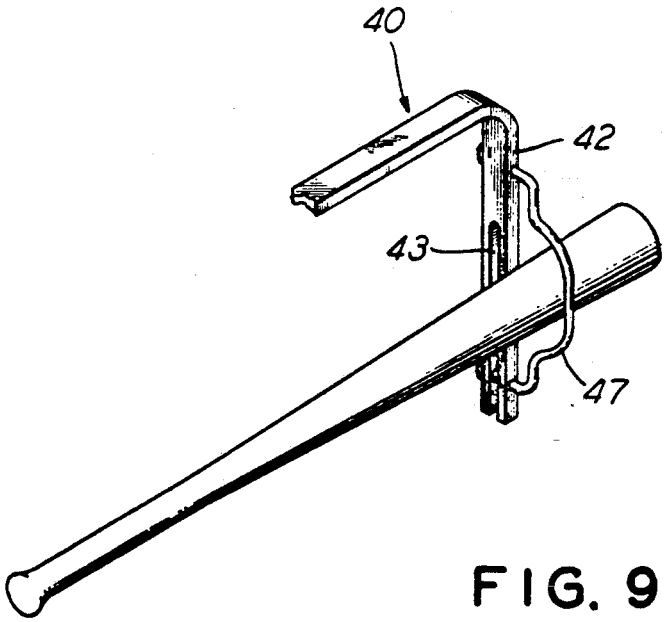
FIG. 9 shows an alternate embodiment of the drive arm with a side bar to accommodate the use of an actual ball bat or tennis racket.

In yet another embodiment of the invention, the use of an actual ball bat or tennis racket as the swing implement is also accommodated, as shown in FIG. 9 of the drawings. In this embodiment, a u-shaped rod 47 is carried on the side of section 42 of swing drive arm 40, forming a closed frame therewith, to engage and contain an actual ball bat or an actual tennis racket when used as swing implements for training. In this case, the side rod can be engaged by the swing implement to forcibly return the drive arm back to a swing starting position or to drive the drive arm forward against resistance for the opposite forward swing direction.

It should be apparent that in addition to the embodiments described, many other engagement means can be used which allow similar degrees of movement of the swing implement as the swing implement drives the swing drive arm in forcible rotation. Examples of such engagement devices are coupled links, flexible loops, or sliding bearings. The actual attachment of the shaft of the swing implement to the swing drive arm is purposely avoided to facilitate switching swing implements from one sport to another, where different handle configurations are used and different shaft lengths may be desirable.

With this swing machine, each time a swing is made the drive arm 40 must return to a neutral swing starting position by pivoting in the reverse rotational direction from the forward swing, prior to making the next swing. This is referred to as the return or back swing. When viewed from overhead for a baseball swing or a forehand tennis stroke, or viewed from the front (or face to face) for a golf swing, a right-handed forward swing means a counter-clockwise rotational direction, and a left-handed swing refers to a clockwise rotation.

It is apparent that a right-handed forward swing will have the same rotational direction as the back swing from a left-handed forward swing. Also, in tennis, a right-handed backhand stroke is considered a forward swing, but it has the same rotational direction as a left-handed forehand stroke and therefore would be referred to as a left-handed swing direction. Because each repetitive training swing must be accompanied by a back swing in the reverse direction, it needs to be clear that right and left-handed swings refer to the initial or forward swing from the swing starting position, as described.

Resistance to a forward swing acts essentially perpendicular to the shaft 52 at the slot 43 of swing drive arm 40 as it moves in an arc through a forward swing path. This resistance is provided by the linearly extendable member of the resistance device which can be a mechanical spring, fluid damper or dash-pot, friction damper, or a combination thereof, as explained, acting through the flexible tension strap 28, the anchor pin 31, and the linkage plate 30 against the leading side of drive arm carrier 33.

Figure 5:
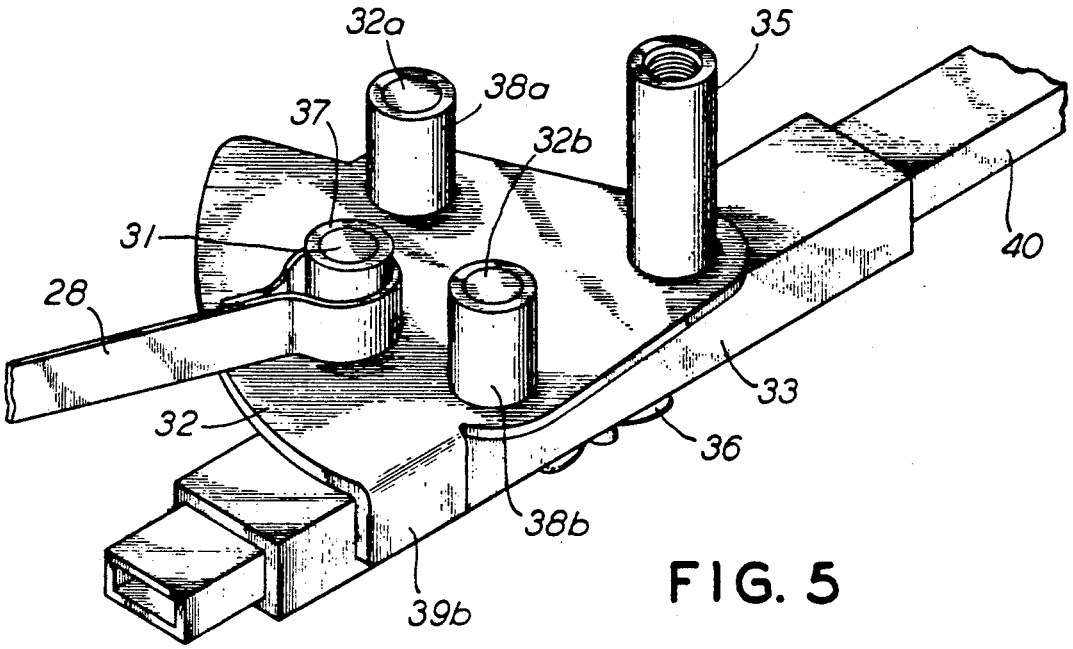
FIG. 5 is an isometric view of the linkage plate and drive arm carrier assembly, also showing a portion of the tension strap as connected to the linkage plate.

While the flexible strap 28 is depicted in the embodiments shown on FIGS. 1, 2, and 7 of the drawings as a belt, it can similarly be a single strap having a connecting loop or other connecting means on the ends, as indicated on FIG. 5.

The entire swing mechanism 20, when longitudinally aligned, is symmetrical about its longitudinal centerline, such that it is operable equally in either right or left-handed forward swing directions. The linkage plate 30 is pivotable and slidable on top of drive arm carrier 33, and engages the carrier by means of projecting drive tabs 39*a* or 39*b* on one side or the other. Therefore, either right-handed or left-handed swings, or forehand and backhand forward tennis strokes, can be accommodated without making any changes to the mechanism. In the preferred embodiments a limited zone of unrestricted pivoted travel of the drive arm carrier 33 and the drive arm 40 is provided between the projecting tabs 39*a* and 39*b* of the linkage plate 30, allowing a limited range of unresisted pivoted rotation of the drive arm and the swing implement 50 at the full backswing or swing starting position. This neutral range is desirable to accommodate individual variations in comfortable positioning of the swing implement that typically prevail in the ready position or swing stance, particularly in the sport of baseball.

In FIGS. 7A through 7F of the drawings, a sequence of positions throughout a swing is illustrated, viewing the drive arm carrier 33 from the top side on which the linkage plate 30 lies. Shown in the various views on this outline drawing are the linkage plate 30 with connecting anchor pin 31 and left and right-hand strap pickup pins 32*a* and 32*b*, respectively, the drive arm carrier 33, a short, truncated portion of the drive arm 40, and a portion of the flexible tension strap 28. The tension strap 28 is connected, on the end not shown, to the extendable member of the resistance device 26 which is anchored to the beam 24 on its other end. The direction of swing movement is indicated by arched arrows drawn on the end of the drive arm carrier 33 from which the swing drive arm 40 extends.

As illustrated and will now be described, the flexible tension strap 28, combined with the linkage plate 30 and the pins carried thereon, serve as a linkage mechanism for transmitting the linear resistance force, developed by the forcible extension of resistance device 26, to the swing drive arm carrier 33 and the swing drive arm 40; and this linkage also serves to translate the linear resistance force into rotational swing resistance, or torque, acting on the pivotable drive arm 40 throughout a full 360 degrees or more of swing rotation. Furthermore, this linkage arrangement, by means of drive tabs 39*a* and 39*b* which straddle the drive arm 40, the plurality of projecting pins carried on the linkage plate 30, and radial dimensioning of the slip sleeve 45, can be designed to develop virtually any desired pattern of minimum to maximum resistance torque throughout the full rotation of the swing.

Figure 7A:
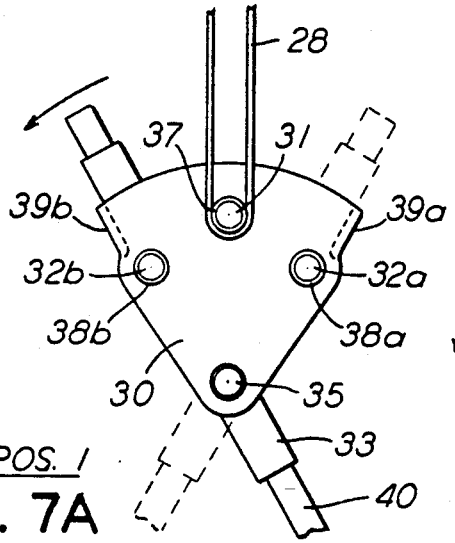
FIGS. 7A through 7F are a series of overhead outline drawings illustrating the orientation and position of the tension strap relative to the linkage plate and drive arm carrier for a sequence of positions during a training swing.

In the view of position 1 of FIG. 7A, the assembly is shown at the full backswing position, with connecting anchor pin 31 generally in line with the tension strap 28 and the swing pivot pin 35. The projecting drive tabs 39*a* and 39*b* of plate 30, which contact one side or the other of drive arm carrier 33, are hidden on this view but are indicated by the short dashed lines parallel to either side of the plate 30. In position 1, the drive arm carrier 33 is shown in the starting position for a right-handed forward swing in solid lines and is phantomed in a left-handed starting swing position as dashed lines. It can be appreciated that in this full backswing position, the drive arm carrier 33 and the drive arm 40 are free to rotate between the left and right-hand drive tab contact positions, with no contact and therefore no resistance imparted from either of these projecting tabs of the linkage plate 30. Furthermore, since the entire assembly is symmetrical about a line through the centers of connecting pin 31 and the axis of swing pivot pin 35, equal resistance action would occur for forward swings driving the drive arm in one swing direction or the other.

The force applied to the swing drive arm 40 by the shaft 52 of the hand held swing implement 50 drives the mechanism by exerting force on the drive arm carrier 33, which abuts projecting tab 39*a* or 39*b* and drives the linkage plate 30, which turns about the axis of pivot pin 35 such that connecting pin 31, and eventually pickup pin 32*a* or 32*b*, pulls the flexible strap 28, overcoming the resistance imparted by forcible linear extension of the resistance device 26 and, in turn, transmitting this resistance to the drive arm carrier 33, the drive arm 40 and the swing implement 50.

Figure 7B:
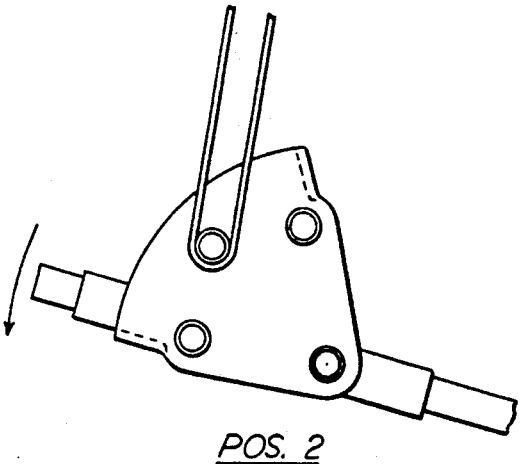

Position 2 on FIG. 7B illustrates how the path of the connecting pin 31 has moved it away from the resistance device (downward on the drawings) and also has moved the line of force away from the axis of pivot pin 35, when compared to the starting position. The downward movement, on the drawing, causes a resistive force to be transmitted through the strap 28 and pin 31, and the outward movement of the line of force increases the length of the moment arm for the resistance torque on the drive arm 40 about the axis of pivot pin 35, which effectively increases this torsional resistance.

Figure 7C:
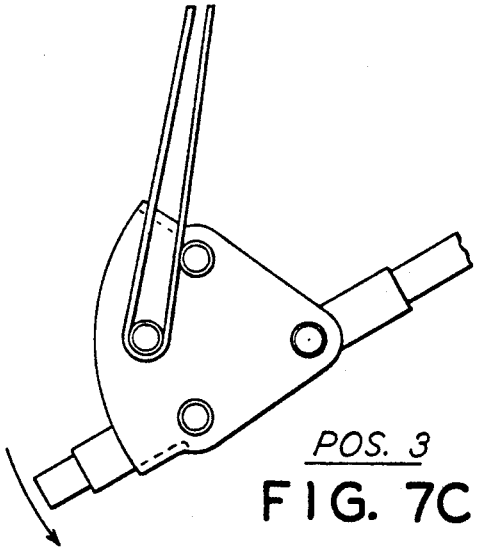

In position 3, FIG. 7C, of the moment arm from the axis of pin 35, to the line of resistive force on connecting pin 31, is maximized, as is the rate of lengthening of the resistance device per degree of rotation about pivot pin 35. For embodiments of this invention which include a fluid pressure damper as the resistance device 26, this amount of linear extension per degree of swing rotation is generally proportional to the resistance force generated, throughout the swing. In this case resistance is generated only through movement, and the more linear extension movement there is, the more resistance must be overcome per degree of rotation.

Figure 7D:
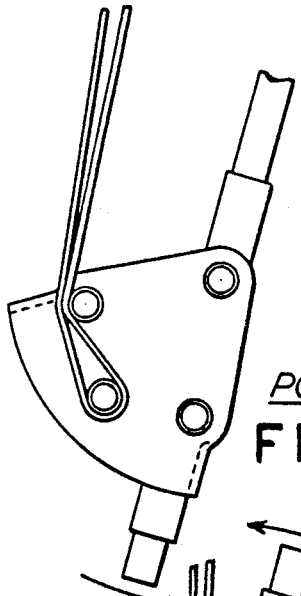

When position 4, FIG. 7D, is reached, the right-hand pickup pin 32*a* has rotated to where its slip sleeve 38*a* has come into lateral contact with the flexible tension strap 28. From position 4 to position 5 in the swing, it is the path of pickup pin 32*a*, rather than that of connecting pin 31, which controls the location and distance of the pull on the strap 28 and thereby determines the rate of linear extension of the resistance device 26 per degree of drive arm rotation. In this swing zone the pickup pin 32*a* also determines the line of force and the corresponding length of the effective torque moment arm from the axis of pivot pin 35. By picking up the tension strap 28 at position 4, instead of allowing connecting pin 31 to continue to determine the effective pulling path, the zone of the swing where a relatively high resistance torque is in effect is lengthened. This is due primarily to the fact that the pickup pins are located such that the effective moment arm, from the axis of pivot pin 35 perpendicular to the line of force, diminishes later in the swing when the pickup pin 32*a*, rather than connecting pin 31, controls the pull on the flexible tension strap 28. The strap 28 is thus wrapped around the sleeve bearing of either pickup pin 32*a* or 32*b*, depending on the forward swing direction.

Figure 7E:
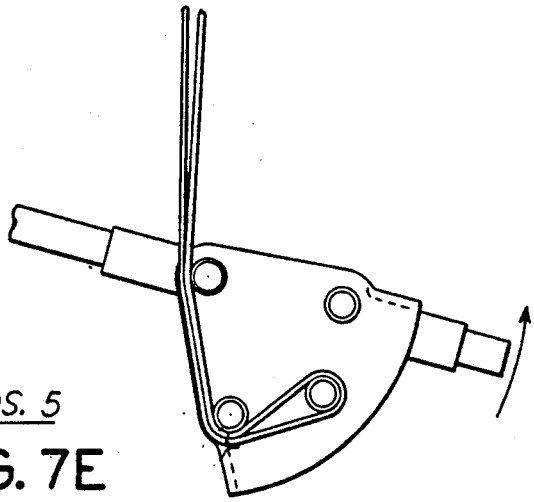
Figure 7F:
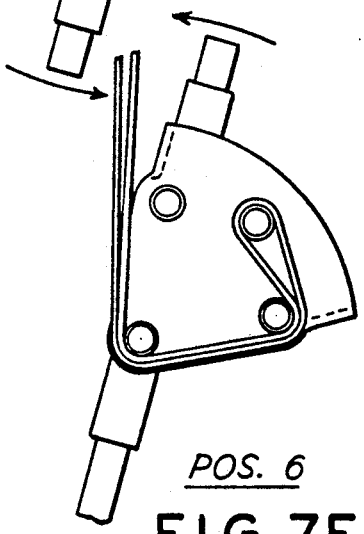

When position 5, FIG. 7E, is reached, the flexible tension strap 28 is brought into lateral contact with a sleeve bearing 45 mounted around bushing 48 and therefore having a longitudinal center axis essentially concentric with the turning axis of pivot pin 35. The outside surface of the sleeve 45 thereby sets the effective radial moment arm for the resistance torque throughout the final followthrough stage of the swing, from position 5 to position 6, shown in FIG. 7F. It should be appreciated that a relatively constant resistance torque can be obtained for any desired portion of the swing simply by allowing the tension strap 28 to ride on the fixed radius surface of such a sleeve around pivot pin 35, or bushing 48. When this pickup sleeve is mounted around the projecting bushing 48, as shown, rather than on pin 35, the side load imparted by tension belt 28 is transmitted more directly to the beam 24.

The pickup pins 32*a* and 32*b*, in the embodiment represented by FIG. 5, are each displaced rotationally from a centerline through pin 31 and pin 35 by approximately 35 degrees, and the distance from the outside of the pins 32*a* and 32*b* to the center of pivot pin 35 is approximately 80% of the distance from this center to the outside of pin 31. It should also be appreciated that the resistance torque can easily be increased simply by increasing the distance between pin 31 and pivot pin 35; and the effect of pickup pins 32*a* and 32*b*, in terms of where in the swing zone they pick up the tension strap 28 and of their torsional effect, can be varied as might be desired by changing either the locating angle from pin 31 or the distance between the pins 32*a* and 32*b* and pivot pin 35, or a combination thereof. It is also apparent that additional pickup pins could be added to further extend the high torsional resistance zone of the swing, or, alternately, a continuous cam shaped member can be fixed to and protruded from the top surface of the linkage plate 30 to smoothly provide virtually any desired torsional swing resistance pattern desired throughout the swing rotation.

Figure 10:
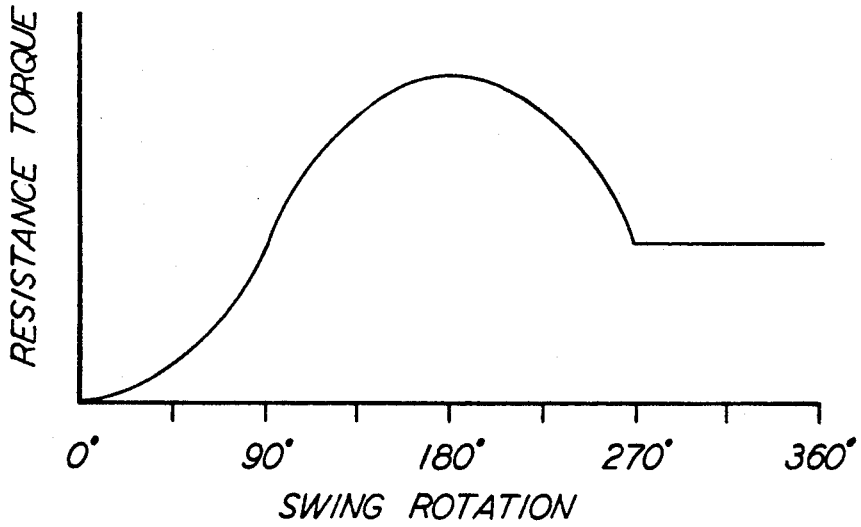
FIG. 10 is a graph illustrating the general relationship of resistance torque to swing rotation of the drive arm for one embodiment of the invention.

FIG. 10 of the drawings is a graph illustrating the general relationship of the resistance torque to degrees of rotation of the drive arm during a training swing. This curve is generally representative of the torque for the linkage plate depicted in FIG. 5 from a fluid damper combined with a nominal return spring. As shown here, after leaving the free or unresisted zone of the swing, the torque builds up gradually from the start of the swing, to a maximum just prior to the impact zone of the swing, and then reduces for the followthrough.

USE AND OPERATION OF THE SWING TRAINING MACHINE

When using the swing training machine, a trainee selects a swing implement appropriate to the sport the wishes to train for. He also readies the machine by adjusting the length of the drive arm 40 by sliding it to the desired position within drive arm carrier 33 and locking it in position with set screw 36, and by pivoting the beam 24 and the operating assembly 20 into the angular position required for the desired swing plane and locking it into position by tightening locking bars 22*a* and 22*b* about suspension bar 15 using the cam operated clamp 18. The desired resistance is set by adjusting the pre-load on the tension resistance spring 26*a* using screw crank 16, as depicted on FIG. 2; or, if using an embodiment of the invention which utilizes an adjustable fluid damping device 26, as shown on FIG. 6, the extension resistance can be adjusted as desired using an external orifice adjustment such as that depicted by the adjusting knob 66.

If desired, containment pins 44*a* and 44*b* may be inserted into the appropriate holes provided in the drive arm, to restrict the limits of the swing plane that will be followed by the shaft of the swing implement. The trainee then engages the shaft of the hand held swing implement 50 with the swing drive arm 40, either by sliding this shaft through the slot 43 or by abutting the swing implement against the outside surface of the drive arm. Facing the upright post, the trainee assumes a swing position for either a right-handed or left-handed swing, or, if training for tennis, for a forehand or backhand swing. During training, the trainee repeatedly and forcibly swings the swing implement, engaging and driving the drive arm 40 in pivoted rotation through approximately a full 360 degree swing, overcoming the resistance torque produced by the resistance device 26 acting through the linkage mechanism, including the strap 28 and the plate 30, on drive arm 40, returning effortlessly to the swing starting position following each such forcible forward swing.

Alternately, a trainee may choose to utilize a more restricted zone of the swing, such as the first 45 degrees of rotation, to specifically focus on working certain muscles such as the shoulders, or through a relatively small angle in the middle of the swing, simply cocking and uncocking the wrists to effectively develop a powerful wrist snap. Such possible variations in training are numerous.

As has been shown and described, the present invention provides an extremely useful and versatile swing training machine which is easy to use and will effectively achieve its objectives. All of the shortcomings of the prior art have been overcome, including improvements in the resistance pattern, the swing range, the swing implements for training, a free and unresisted return swing, accommodation of both right and left-handed swing directions with easy changing from one to the other, and the provision of simple adjustments to accommodate a wide variety of swing positions and types as well as the physical size of trainees..

I claim:

1. A swing training machine operable with a hand held swing implement swung by a trainee for the purpose of improving the specific muscular strength and coordination required to perform a variety of athletic swings, comprising:

a. a frame;

b. a swing drive arm pivotable about an axis and carried on said frame, said drive arm radiating outward from said pivot axis, having a bend and extending to intersect a planar swing path of such swing implement, and said drive arm is engagable and forcibly rotatable about said pivot axis by such swing implement;

c. resistance means anchored by said frame for resisting the pivoted swing rotation of said drive arm through greater than 90 degrees of swing rotation, equally for left and right-handed swing directions from a starting position and providing relatively unresisted return of said drive arm to said starting position, said resistance means having a forcibly extendable member linked to said drive arm and providing greater resistance to extension than retraction.

2. A swing training machine operable with a hand held swing implement having a handle portion with a shaft portion extending therefrom, said machine comprising:

a. a frame;

b. an elongated swing drive arm pivotable about an axis and carried by said frame, said drive arm radiating outward from said pivot axis and extending at an angle of less than 90 degrees from said pivot axis to intersect a planar swing path followed by said swing implement when swung in training;

c. means for engaging said drive arm with such swing implement whereby such swing implement, when forcibly swung from a starting position during training, engages said drive arm and drives it in rotation about said pivot axis, said engagement means at least partially guiding such swing implement within a generally planar swing path while allowing substantial angular and radial movement of such swing implement relative to said drive arm during the swing;

d. resistance means for generating resistance to motion, said resistance means being anchored by said frame and having a forcibly extendable member, said member providing a greater resistance to extension than to retraction;

e. linkage means, linking said extendable member to said drive arm, for forcibly extending said extendable member and transmitting the resistance force thereby generated to said swing drive arm through greater than 90 degrees of swing rotation from a starting position, equally for right and left-handed training swings and retracting said resistance means as said drive arm is returned to said starting position thereby providing a relatively unresisted return of said drive arm to said starting point, said linkage means being supported by said frame and engagable and forcibly pivotable about an axis by said drive arm.

3. The swing training machine of claim 2 further comprising resistance adjustment means for varying the amount of resistance generated by said resistance means.

4. The swing training machine of claim 3 further characterized in that said resistance means comprises a cylindrical fluid damping device; and said extendable member comprises a pull rod extending from a piston operable within said damping device.

5. The swing training machine of claim 4 wherein said resistance adjustment means comprise's an adjustable fluid flow valve controlling the capacity for fluid to flow from a first compression chamber to a second chamber within said cylindrical damping device, as so forced to flow by movement of said piston drawn by the extension of said pull rod, thereby controlling fluid pressure resisting such movement of said piston and pull rod.

6. The swing training machine of claim 4 wherein said resistance means further comprises a mechanical spring aligned to work in concert with said fluid damping device, further resisting forcible extension of said pull rod and forcibly assisting retraction of said pull rod.

7. The swing training machine of claim 3 wherein said resistance means comprise's a mechanical spring.

8. The swing training machine of claim 7 wherein said resistance adjustment means comprises a screw mechanism carried on said frame and operable to vary the anchoring position of one end of said spring, thereby varying the force output of said spring acting on said drive arm.

9. The swing training machine of claim 3 further comprising a drive arm carrier interposed between said frame and said drive arm, said carrier being pivotable about an axis, connected to said frame and holding said drive arm, said drive arm being longitudinally slidable relative to said carrier and lockable thereto, thereby providing an adjustment for varying the effective radial length of said drive arm.

10. A swing training machine operable with a hand held swing implement having a handle portion with a shaft portion extending therefrom, said machine comprising:

a. a frame;

b. an elongated swing drive arm pivotable about an axis and carried by said frame, said drive arm radiating outward from said pivot axis and extending at an angle of less than 90 degrees from said pivot axis to intersect a planar swing path followed by said swing implement when swung in training;

c. means for engaging said drive arm with such swing implement whereby such swing implement, when forcibly swung forward during training, engages said drive arm and drives it in rotation about said pivot axis, said engagement means at least partially guiding such swing implement within a generally planar swing path while allowing substantial angular and radial movement of such swing implement relative to said drive arm during the swing;

d. resistance means for generating resistance to motion, said resistance means being anchored by said frame and having a forcibly extendable member, said member providing a greater resistance to extension than to retraction;

e. linkage means, linking said extendable member to said drive arm, for forcibly extending said extendable member and transmitting the resistance force thereby generated to said swing drive arm through greater than 90 degrees of swing rotation from a starting position, equally for right and left-handed training swings and retracting said resistance means as said drive arm is returned to said starting position, said linkage means being supported by said frame and engagable and forcibly pivotable about an axis by said drive arm;

f. resistance adjustment means for varying the amount of resistance generated by said resistance means;

g. a drive arm carrier interposed between said frame and said drive arm, said carrier being pivotable about an axis, connected to said frame and holding said drive arm, said drive arm being longitudinally slidable relative to said carrier and lockable thereto, thereby providing an adjustment for varying the effective radial length of said drive arm; and h. wherein said linkage means comprises a flexible tension strap and a linkage plate, said flexible strap being connected on one end to said extendable member of said resistance means and connected on its other end to said linkage plate, said linkage plate being supported by said frame and engagable and forcibly pivotable about said pivot axis of said linkage means by said drive arm.

11. The swing training machine of claim 10 further comprising a cylindrical projection carried on said frame and an outer sleeve bearing carried on said projection, said flexible strap being wrappable about said sleeve bearing of said projection during such forward swing.

12. The swing training machine of claim 10 further characterized by said linkage plate being mounted astride said drive arm carrier, with said pivot axis of said linkage plate generally concentric with said pivot axis of said carrier, said plate being pivotable independent of said carrier through a limited range of rotation and engagable by said carrier at either limit of this range such that said plate is driven in pivoted rotation by said carrier when so engaged during a forward training swing and said flexible strap is pulled by said linkage plate, said plate having at least one protrusion, said protrusion having a lateral bearing surface generally parallel to said pivot axis of said plate, said tension strap wrappable about said bearing surface of said protrusion during said swing, said bearing surface thereby determining the location and distance of the pull transmitted to said strap and therefore to said extendable member and the consequent torsional resistance imparted to said drive arm during a part of said swing.

13. The swing training machine of claim 12 wherein said linkage means further comprises:

a. an anchor pin carried on a first surface of said linkage plate for attaching one end of said flexible tension strap, with said linkage plate being generally symmetrical about a centerline passing through the centers of said anchor pin and said pivot axis of said plate;

b. two drive tabs protruding generally perpendicular from a second surface of said linkage plate, said drive tabs straddling said drive arm carrier and aligned for one to come into abutting engagement with a leading side of said carrier during training swings, said drive tabs being spaced apart such that when one engages a side of said carrier, a space exists between the other said drive tab and an opposite side of said carrier, thus providing for said limited range of independent relative pivot rotation between said linkage plate and said drive arm carrier which prevails when said drive arm is in a neutral swing starting position;

c. said protrusion on said linkage plate including at least two pickup pins protruding from said first surface of said linkage plate and symmetrically positioned about said centerline, thereby acting equally for right and left-handed swings.

14. The swing training machine of claim 13 further comprising cylindrical slip sleeve bearings mounted on said pickup pins, said sleeve bearings of said pickup pins being free to rotate on said pins and providing said bearing surface for engaging said flexible strap.

15. A swing training machine operable with a hand held swing implement having a handle portion with a shaft portion extending therefrom, said machine comprising:

a. a frame;

b. an elongated swing drive arm pivotable about an axis and carried by said frame, said drive arm radiating outward from said pivot axis and extending at an angle of less than 90 degrees from said pivot axis to intersect a planar swing path followed by said swing implement when swung in training;

c. means for engaging said drive arm which such swing implement whereby such swing implement, when forcibly swung forward during training, engages said drive arm and drives it in rotation about said pivot axis, said engagement means at least partially guiding such swing implement within a generally planar swing path while allowing substantial angular and radial movement of such swing implement relative to said drive arm during the swing;

d. resistance means for generating resistance to motion, said resistance means being anchored by said frame and having a forcibly extendable member, said member providing a greater resistance to extension than to retraction;

e. linkage means, linking said extendable member to said drive arm, for forcibly extending said extendable member and transmitting the resistance force thereby generated to said swing drive arm through greater than 90 degrees of swing rotation from a starting position, equally for right and left-handed training swings and retracting said resistance means as said drive arm is returned to said starting position, said linkage means being supported by said frame and engagable and forcibly pivotable about an axis by said drive arm;

f. resistance adjustment means for varying the amount of resistance generated by said resistance means; and g. wherein said linkage means comprises a flexible tension strap and a linkage plate, said flexible strap being connected on one end to said extendable member of said resistance means and connected on its other end to said linkage plate, said linkage plate being supported by said frame and engagable and forcibly pivotable about said pivot axis of said linkage means by said drive arm.

16. The swing training machine of claim 15 wherein said frame comprises:

a. an upright post;

b. a cantilevered suspension bar slidably carried on said post, said suspension bar being lockable to said post within a range of vertical positions, thereby providing a variable height adjustment of said suspension bar; and c. an elongated beam pivotably carried on and lockable to said suspension bar within a range of pivoted rotational positions, said beam anchoring said resistance means and pivotably carrying said drive arm, an angular orientation of the axis of pivot rotation of said drive arm being adjustable by the pivoting of said beam on said suspension bar.

17. The swing training machine of claim 16 wherein said frame further comprises a base platform on which the trainee stands to perform training swings, said platform supporting said upright post.

18. The swing training machine of claim 16 wherein said upright post wedges tightly between a floor and a ceiling of a structure for stability.

19. The swing training machine of claim 15 wherein said frame is suspended from an overhead structure.

20. The swing training machine of claim 15 wherein said engagement means comprises an elongated slot in said drive arm through which passes the shaft portion of such swing implement, said slot having opposing lateral surfaces which abut a side of said shaft during forward and return swings of said drive arm.

21. The swing training machine of claim 15 wherein said engagement means comprises opposite outward lateral surfaces on a section of said drive arm, one said surface abutting the swing implement during a left-handed training swing and the opposite said surface abutting the swing implement during a right-handed swing.

22. The swing training machine of claim 21 further characterized in that the effective length of said lateral engagement surfaces is restricted by movable spaced apart bars carried on and protruding from said drive arm, constraining the swing path of the swing implement within a limited planar range.

23. The swing training machine of claim 21 wherein said drive arm further comprises a generally u-shaped side bar carried on a lateral surface of said drive arm and forming a closed frame therewith, through which such swing implement can be inserted, said side bar providing an engagement surface between said drive arm and such swing implement.

24. A swing training machine comprising:

a. a frame;

b. a hand held swing implement having a handle portion with an elongated shaft portion extending therefrom;

c. a swing drive arm pivotably carried on said frame and positioned generally overhead of a trainee, said drive arm radiating outward from its pivot axis and extending to intersect a planar swing path of said swing implement, at which intersect said drive arm is engagable and rotatable about its pivot axis by said swing implement when swung in training; and d. adjustable resistance means for generating resistance to motion, said resistance means anchored by said frame and comprising a forcibly extendable member linked to said drive arm to resist pivoted swing rotation of said drive arm through greater than 90 degrees of swing rotation in both a right-hand and left-hand direction from a starting position, while allowing relatively unresisted return swings of said drive arm to said starting position; and e. linkage means interposed between said extendable member and said drive arm for transmitting the resistance force generated by said resistance means to said drive arm equally for right and left-handed training swing, said linkage means being supported by said frame, linked to said extendable member, and engaging said drive arm during swings.

25. The swing training machine of claim 24 wherein said resistance means comprises a device selected from the group consisting of cylindrical fluid damping devices and mechanical springs.

26. The swing training machine of claim 24 wherein said shaft portion of said swing implement comprises a relatively small diameter rod having a lateral protrusion near its end.

* * * * *